US005921911A

United States Patent [19]

Hart

[11] Patent Number: 5,921,911

[45] Date of Patent: Jul. 13, 1999

[54] METHODS OF INHIBITING FOAM FORMATION IN ALKANOLAMINE SYSTEMS

[75] Inventor: Paul R. Hart, The Woodlands, Tex.

[73] Assignee: BetzDearborn Inc., Trevose, Pa.

[21] Appl. No.: 08/932,138

[22] Filed: Sep. 16, 1997

[51] Int. Cl.[6] ..... B01D 19/02

[52] U.S. Cl. ..... 516/134; 423/228; 423/226; 208/236; 208/289

[58] Field of Search ..... 252/321, 331, 252/358; 208/236, 289; 516/133, 134; 423/226, 228

[56] References Cited

U.S. PATENT DOCUMENTS

| | | | |
|---|---|---|---|
| Re. 29,428 | 10/1977 | Homberg et al. | 423/228 |
| 2,390,899 | 12/1945 | Reed | 423/228 |
| 3,862,243 | 1/1975 | Bellos | 252/358 |
| 4,060,501 | 11/1977 | Naylor et al. | 516/134 |
| 4,183,903 | 1/1980 | Melchior et al. | 423/228 |
| 4,313,917 | 2/1982 | Ohta | 252/321 |
| 4,343,716 | 8/1982 | Melchior et al. | 423/226 |
| 4,344,863 | 8/1982 | Robbins et al. | 252/358 |
| 4,396,499 | 8/1983 | McCoy et al. | 252/358 |
| 5,114,566 | 5/1992 | Naeger et al. | 208/289 |
| 5,256,305 | 10/1993 | Hart | 252/358 |
| 5,354,505 | 10/1994 | Mendoza | 252/358 |
| 5,407,585 | 4/1995 | Taylor et al. | 252/331 |
| 5,476,988 | 12/1995 | Hart et al. | 208/289 |

*Primary Examiner*—Richard D. Lovering
*Assistant Examiner*—Daniel S. Metzmaier
*Attorney, Agent, or Firm*—Steven D. Boyd

[57] ABSTRACT

A method for inhibiting foam formation in a stripper of an amine unit is disclosed. The addition of non-foaming demulsifiers to the liquid, compressed hydrocarbon stream entering or the aqueous organic amine stream entering or exiting an absorber of an amine unit effectively inhibits foam formation in the amine unit stripper. Foam formation in the stripper is inhibited by controlling the entrainment of hydrocarbon in the alkaline amine stream entering the stripper through demulsification treatment in the absorber.

3 Claims, No Drawings

METHODS OF INHIBITING FOAM FORMATION IN ALKANOLAMINE SYSTEMS

FIELD OF THE INVENTION

The present invention relates to a method of inhibiting foam formation in an alkanolamine system in an oil refinery. More particularly, the present invention relates to a method of inhibiting the foam formation in the stripper of an alkanolamine system caused by entrained light hydrocarbons by adding an oil-in-water demulsifier to the liquid/liquid absorber.

BACKGROUND OF THE INVENTION

In an oil refinery, an amine unit is a processing unit that removes acid gases from a hydrocarbon process flow. The primary acid gases to be removed are hydrogen sulfite and carbon dioxide. Acid gases are commonly removed by contacting the hydrocarbon stream with an aqueous organic amine such as monoethanolamine (MEA), diethanolamine (DEA), methyldiethanolamine (MDEA), diisopropanolamine (DIPA), diglycolamine (DGA) or triethanolamine (TEA) diluted in water as an amine solvent. The amine solvent reacts with the acid gases in an absorber, thereby removing them from the hydrocarbon stream. The amine-acid gas reaction is later reversed in a stripper, resulting in an acid gas stream and a reusable solvent stream.

In the treatment of light hydrocarbons (C1–C7) in an amine unit, emulsions of the hydrocarbon in the aqueous organic amine can form. In addition, droplets of the aqueous organic amine can become emulsified in the liquid hydrocarbon stream (a water-in-oil emulsion) contaminating downstream hydrocarbon processing units. The residence time of the aqueous organic amine stream in the absorber is not sufficient to allow resolution or breaking of such emulsions. When such light hydrocarbon-in-water emulsions reach the stripper, the light hydrocarbon can expand from a liquid to a vapor causing uncontrollable foaming. The formation of foam in the stripper unit is undesirable and can overwhelm the separation process in the stripper. Typical attempts to control foaming in the stripper include the use of antifoams (silicone and nonsilicones), increasing the aqueous amine stream temperature, installation of a flash drum, and/or installation of an inlet gas separator. While such methods exhibit some efficacy, they are usually only partially successful or are costly to implement.

SUMMARY OF THE INVENTION

The present inventor discovered that the addition of certain chemical demulsifiers to one or more of the liquid streams entering the absorber of an amine unit and/or the organic amine stream exiting the absorber, substantially reduces the presence of liquefied hydrocarbon gasses entrained in the acid gas rich, aqueous, amine stream. This reduction in liquefied hydrocarbons in the acid gas rich, amine stream significantly reduces foam formation in the stripper. Fouling deposits in the stripper are also significantly reduced. The reduction in foaming and fouling in the stripper enhances operation of the amine unit.

DESCRIPTION OF THE PREFERRED EMBODIMENT

The present inventor discovered that the addition of certain non-foaming demulsifiers to the liquid, compressed hydrocarbon stream entering or the aqueous, organic amine stream entering or exiting an absorber of an amine unit will effectively prevent the formation of foam in the amine unit stripper without fouling the exchangers, trays, or filters of the unit. The typical amine unit is employed in hydrocarbon refining to remove acid gases from a hydrocarbon process flow. An amine unit typically includes an absorber where the acid gas containing hydrocarbon stream is contacted with a lean amine stream. The absorber is a high pressure, low temperature vessel in which the acid gas present in the hydrocarbon stream reacts with the aqueous, organic amine and is removed from the hydrocarbon stream. An undesirable action which can also occur in the absorber is the formation of hydrocarbon-in-water or water-in-hydrocarbon emulsions. If water-in-hydrocarbon emulsions form, the presence of water in the hydrocarbon stream can contaminate the downstream hydrocarbon processing units. The formation of hydrocarbon-in-water emulsions can adversely impact treatment of the aqueous, organic amine stream prior to its reuse.

The aqueous, organic amine stream, after reaction with the acid gas, is treated in a stripper where the reaction between the acid gas and the amine solvent is reversed so that the aqueous organic amine can be reused. The stripper is a high temperature, low pressure unit. If compressed, gaseous hydrocarbon is emulsified in the aqueous, organic amine stream, then, at the low pressure and high temperature of the stripper, it will vaporize, causing foam formation.

The use of conventional antifoam agents in the stripper to control undesired foam formation has been found to be of limited usefulness when compressed gas is entrained. Moreover, their use can cause undesirable side effects such as sludging or fouling of trays, packing, exchangers, and filters. The addition of an inlet gas separator or flash drum can inhibit foam formation in the stripper but is a costly, capital intensive solution.

The present inventor discovered that foam formation in a stripper could be significantly reduced, without undesirable side effects, by adding a non-fouling, non-foam-stabilizing demulsifier to one or more of the streams fed to the absorber, or the aqueous, organic amine stream leaving the absorber. The non-foam-stabilizing demulsifier inhibits the formation or stabilization of hydrocarbon and amine emulsions which form in the absorber, thus reducing the carryover of hydrocarbon foamant to the stripper. This decreases the rate of foam formation without excessively increasing the stability of the foam that is formed by the gas being stripped, for an overall net reduction in foaming. As an added benefit, it was found that the addition of these demulsifiers to the hydrocarbon stream or the aqueous, organic amine stream fed to the absorber also inhibits the formation or stability of amine-in-hydrocarbon emulsions and any subsequent emulsions, of caustic or wash water in the hydrocarbon, found downstream. These emulsions can adversely effect downstream hydrocarbon processing units.

The demulsifiers of the present invention are selected from the group consisting of alkoxylates of the following: alkylphenols, alkylamines, alkylols and/or polyols with or without cross-linking with aldehydes, di- or multifunctional acids, epoxides, and isocyanates. These are selected singly or in combinations such that the overall content of ethylene oxide (EO) is less than about 50%, if all components are branched or crosslinked, or less than about 40% if all are not, and further provided that any unbranched, uncrosslinked component has a molecular weight less than about 3 kD.

The preferred demulsifiers of the present invention are diepoxide cross-linked alkoxylated diols, preferably, the alkoxylated adducts of poly(propylene glycol) and the diglycidyl ether of 2,2 bis-p-phenol propane (Epon 828). These were found to quickly and cleanly break hydrocarbon-in-amine and amine-in-hydrocarbon emulsions formed in alkanolamine absorbers. The diepoxide demulsifiers are preferably made with polypropylene glycol having a molecular weight from about 2,000 to 10,000. The preferred mole ratio of polypropylene glycol to diglycidyl ether of 2,2 bis-p-phenol propane ranges from about 1:3 to about 3:1. Optionally up to 60 wt. % propylene oxide (PO) and up to 30 wt. %, preferably 10–20% ethylene oxide (EO) is subsequently reacted. Commercially available compounds of this type include Arbreaks 139 and 1070 from Aquaness, a division of Baker Hughes; Witbreaks DRI-9010, -9016, -9020 and -9025 from Witco Chemical Corp.; Special Product 1047 from Champion; Kemelices D400, D401 and D316 available from ICI; and Dissolvans 2820, 3431, and 3245 from Hoechst.

Effective dosages of oil-in-water demulsifiers in alkanolamine systems range from about 1 part per million (ppm) to about 10,000 ppm, more typically from about 10 ppm to about 100 ppm.

Effective temperatures at which these oil-in-water demulsifiers are effective in alkanolamine systems range from −20° C. to +100° C.

The present invention will now be described with reference to a number of specific examples, which are to be regarded solely as illustrative and not as restricting the scope of the present invention.

In the examples, the following demulsifiers were employed:

(A) Poly(propylene glycol) diepoxide alkoxylate with 16% EO and MW of 4.0 kD, commercially available from Hoechst as Dissolvan 3245.

(B) Alkylphenol-formaldehyde/poly(propylene glycol) polyalkoxy oligo-(acrylomaleate) with 40% EO and MW of 25 kD, commercially available from Witco as Witbreak DRI-9037.

(C) Poly(propylene glycol) ethoxylate with 40% EO and MW of 3.9 kD, commercially available from BASF as Pluronic P-84.

(D) Alkylphenol-formaldehyde alkoxylate with 50% EO and MW of 2.3 kD, commercially available from Witco as Witbreak DRC-168.

(E) Poly(propylene glycol) ethoxylate with 10% EO and MW of 1.9 kD, commercially available from BASF as Pluronic L-61.

(F) Poly(propylene glycol) ethoxylate with 10% EO and MW of 3.2 kD, commercially available from BASF as Pluronic L-101.

(G) Poly(propylene glycol) with no EO and a MW of 4.0 kD, commercially available from Dow as Dowanol 4000.

(H) Conventional silicone based antifoam, a 125 St dimethylsiloxane fluid, used as a control, commercially available from Witco as OSi SAG-10.

EXAMPLE 1

15 mL of lean, aqueous, organic amine (monoethanolamine or MEA) from an amine unit was placed in a glass tube with 75 mL of (reagent grade) heptane. Chemical treatment was added to the heptane. The tube was heated to 43° C. (a typical scrubber temperature) and mixed for five minutes by shaker. After mixing, the sample was placed back in a 43° C. bath for evaluation. The degree of emulsification immediately after mixing (instantly) and after five minutes was observed. Table 1 summarizes the results.

TABLE 1

| Process MEA | Chemical Treatment | | Results | | | | | |
|---|---|---|---|---|---|---|---|---|
| | | | Heptane Layer Appearance[2] | | I/F Layer[1] Volume (% of MEA) | | MEA Layer Appearance[2] | |
| Sample | Product | ppm Active | Instantly | 5 Min. | Instantly | 5 Min. | Instantly | 5 Min. |
| #1 | Blank | 0 | Clear | Clear | 13% | 7% | Cloudy | Cloudy |
| | A | 12 | Clear | Clear | 0% | 0% | Clear | Clear |
| | B | 10 | Clear | Clear | 7% | 0% | Cloudy | Hazy |
| | C | 17 | Clear | Clear | 13% | 13% | Cloudy | Cloudy |
| #2 | Blank | 0 | Clear | Clear | 13% | 13% | Cloudy | Cloudy |
| | A | 12 | Clear | Clear | 0% | 0% | Clear | Clear |
| | B | 10 | Clear | Clear | 13% | 3% | Hazy | Hazy |
| | C | 17 | Clear | Clear | 13% | 13% | Cloudy | Cloudy |

Notes:
[1]I/F is interface, a layer of emulsion between the lean MEA and heptane layers. (This predicts cross entrainment of phases due to failure to resolve.)
[2]"Cloudy" is opaque; "Hazy" is translucent; "Clear" is transparent.

Table 1 shows that, at typical process temperatures and using heptane as a proxy for actual process hydrocarbon, emulsions of two separate process amines failed to resolve in a reasonable contactor residence time without treatment and that the amount of hydrocarbon that entrained into the amine was a sizable fraction (up to 13%) of the volume of the amine. When vaporized, that much hydrocarbon would comprise a volume 70 times larger than the amine itself, and result in uncontrollable foaming. The treatment of the present invention reduced the potential for foam-inducing entrainment to, in the best case, zero.

EXAMPLE 2

15 mL of lean, aqueous, organic amine (monoethanolamine or MEA) from an amine unit was added to a glass tube. The chemical treatment was added and the tube capped and placed into an ice water bath. 75 mL of liquid propane distillate (LPD) from an amine unit was slowly added from a pressure regulated bomb to the sealed tube through a valve in the tube cap. The valve was closed, the fill line disconnected, and the tube shaken for five minutes by shaker. After mixing, the tube was evaluated for degree of emulsification. Evaluations were made immediately after mixing (instantly) and after five minutes of room temperature exposure. Table 2 summarizes the results.

TABLE 2

| Chemical Treatment | | Results | | | | | |
|---|---|---|---|---|---|---|---|
| | | LPD Layer (Top) | | MEA Layer (Bottom) | | | |
| | | Appearance[1] | | Extra Volume[2] | | Appearance[3] | |
| Product | ppm Active | Instantly | 5 Min. | Instantly | 5 Min. | Instantly | 5 Min. |
| Blank | 0 | Wall[2] | Wall[2] | 33% | 20% | Cloudy | Cloudy |
| A | 17 | Clear | Clear | 0% | 0% | Hazy | Hazy |
| A | 35 | Clear | Clear | 0% | 0% | Hazy | Hazy |
| A | 35 | Clear | Clear | 0% | 0% | Hazy | Hazy |
| B | 27 | Wall[2] | Wall[2] | 7% | 7% | Cloudy | Cloudy |
| C | 30 | Wall[2] | Wall[2] | 20% | 20% | Cloudy | Cloudy |
| D | 30 | Clear | Clear | 13% | 7% | Cloudy | Cloudy |

Notes:
[1]"Wall" means the LPD layer is clear but it has some lean MEA sticking on the wall of the LPD layer. (This predicts entrainment of MEA via fouling of contactor.)
[2]Increase in the volume of lean MEA layer after mixing relative to its original volume. (Since only 15 mL of lean MEA was added, if the volume of lean MEA is larger than 15 mL, it means some LPD is emulsified into the lean MEA.)
[3]"Cloudy" is opaque; "Hazy" is translucent; "Clear" is transparent Table 2 shows that using actual process hydrocarbon at a lower than actual process temperature (for safety reasons) emulsions with actual process amine are even more severe than those made with reagent grade heptane. In the absence of the claimed chemical treatment, liquid propane was finely dispersed into the entire body of the amine layer in an amount equal to 33% of the amine volume (165 times the volume as vapor). The treatment of the present invention reduced that actual entrainment to, in the best case, zero.

The tendency of demulsifiers to stabilize foam has resulted in avoidance of their use in amine units. In a stripper, any reduction in the entrainment of foam generating gas from demulsifier addition was expected to be offset by a countervailing increase in the stability of the foam generated in the stripper. The demulsifiers of the present invention were not found to significantly stabilize foam. The effect of demulsifiers on foam stability was tested as follows:

EXAMPLE 3

250 mL of the lean MEA were poured into a 500 mL cylinder fitted with a condenser head. The cylinder was sparged with nitrogen through a fine pore frit (size D) at 400 mL/min. and heated to 82° C. (a typical stripper temperature). Chemical treatments were added through a septum and their effect on the equilibrium foam height was observed. Surprisingly, some demulsifiers were found to destabilize foam. These were added in progressively higher concentrations to see if foam would be stabilized in an overtreatment situation. Foam destabilization continued to improve to extremely high doses and could be used to counteract the foam stabilization effects of the other demulsifiers. Table 3 summarizes the results.

TABLE 3

| | Chemical Treatment | | | | |
|---|---|---|---|---|---|
| MEA Sample | 1st Product | ppm Active | 2nd Product | ppm Act. | Effect on Foam |
| #2 | A | 17 | — | — | None |
| | B | 14 | — | — | None |
| | C | 15 | — | — | Greatly Increased Foam |

TABLE 3-continued

| | Chemical Treatment | | | | |
|---|---|---|---|---|---|
| MEA Sample | 1st Product | ppm Active | 2nd Product | ppm Act. | Effect on Foam |
| | D | 15 | — | — | Slightly Increased Foam |
| | E | 4600 | — | — | Completely Suppressed Foam |
| | F | 1500 | — | — | Completely Suppressed Foam |
| | G | 5000 | — | — | None |
| | A | 17 | E | 4900 | Completely Suppressed Foam |
| #1 | A | 17 | E | 4500 | Completely Suppressed Foam |

Table 3 shows that all the demulsifiers but C, a poly (propylene glycol) ethoxylate with 40% EO, and to a much lesser extent D, an alkylphenol-formaldehyde alkoxylate with 50% EO, were safe to use as antifoamants, i.e. would have a net antifoaming effect, in alkanolamine units. It also shows that foam stabilization generally decreases with decreasing EO content, so that even the most foam stabilizing type, the poly(propylene glycol) based treatment C, becomes foam destabilizing when it contains around 10% EO (treatments E and F). It also shows that, for the same level of EO, crosslinking, as in B, with oligo(acrylomaleate), and D, with formaldehyde, decreases the foam stabilization, so that a higher, more demulsifying amount of EO can be employed.

Another advantage of these demulsifier compounds over the prior art antifoams is that they do not promote sludge or otherwise foul the unit. As noted earlier, the most effective antifoams currently in use, typically silicone-based, have been associated with increased unit fouling. To determine fouling potential, an overnight precipitation test was done on the most effective antifoaming demulsifiers and a standard, silicone-based control using a lean MDEA solution from an actual process unit, as follows:

EXAMPLE 4

The chemical treatment was added to the amine solution at room temperature until it visibly phased out of the amine solution, then let stand overnight. The amount added, and the appearance of the solution and of the surface of the solution were recorded. The solution was then heated beyond the process temperature to see if the sludge would melt. (All raw materials were liquid in their neat, natural state). The results are summarized in Table 4.

TABLE 4

| Chemical Treatment | | Initial Surface | Overnight | Effect of Heating |
|---|---|---|---|---|
| Product | ppm Active | Appearance | Appearance | Up to 93° C. |
| A | 125 | clear, liquid sheen | clear, liquid sheen | none |
| B | 125 | clear, liquid sheen | clear, liquid sheen | none |
| C | >1000 | does not phase out | does not phase out | none |
| D | 125 | clear, liquid sheen | clear, liquid sheen | none |
| E | 250 | no surface layer | clear, liquid sheen | none |
| F | 125 | white, waxy clumps | white, waxy clumps | none |
| G | 200 | clear, liquid sheen | clear, liquid sheen | none |
| H (control) | 400 | no surface layer | large, floating flocs | none |

Table 4 shows that, unlike the silicone antifoam control, none of the demulsifiers except F, the poly(propylene glycol) ethoxylate with 10% EO and MW of 3.2 kD, exhibited any fouling potential. Moreover, the fouling potential of treatment F could be eliminated by increasing the EO or decreasing the MW sufficiently. None of the crosslinked demulsifiers formed sludge even when containing low EO or high MW. As expected, the silicone-based control exhibited a pronounced fouling potential in the form of large, floating flocs or entangled, insoluble filaments.

EXAMPLE 5

The efficacy of chemical treatment A was determined in an MEA unit where the stripper had been experiencing massive amine carryover due to foaming, which was not controlled with the addition of a conventional silicone antifoam. Treatment A was fed at 17 ppm to the liquid propane distillate (LPD) being fed to the MEA countercurrent scrubber. Within minutes of feeding treatment A, samples of amine feeding the downstream stripper turned from their previous, opaque, cloudy appearance to clear, and foaming in the stripper ceased. In addition, the LPD leaving the scrubber turned from cloudy to clear, eliminating downstream separation/product contamination problems.

A few weeks later a slop oil was fed to the scrubber. In the past, slop oil had been unprocessable due to uncontrollable foaming in the stripper. Treatment A continued to be fed at 17 ppm to the LPG and a large amount of the slop oil was processed. As the amount of slop oil being processed continued to be increased, however, the stripper began to foam again, eventually spilling amine into the overhead. An extra 50 ppm of compound E was fed to the amine solution and even this foaming ceased.

Three months later there was still no sign of the heat transfer loss or differential pressure increase characteristic of the fouling or sludging induced by the prior art antifoam.

This trial shows that these non-fouling, non-foaming demulsifiers provided improved foam control in an alkanolamine unit without deleterious long-term consequences.

While the present invention has been described with respect to particular embodiments thereof, it is apparent that numerous other forms and modifications of the invention will be obvious to those skilled in the art. The appended claims and this invention generally should be construed to cover all such obvious forms and modifications which are within the true scope and spirit of the present invention.

What is claimed is:

1. A method of reducing entrained hydrocarbon induced foaming in a stripper section of an aqueous amine acid gas absorber separation process employing an aqueous alkaline amine stream consisting essentially of monoethanolamine, diethanolamine, methyldiethanolamine, diisopropanolamine, diglycolamine, triethanolamine or mixtures thereof comprising adding an effective amount for the purpose of inhibiting foam formation of a non-foaming demulsifier comprising diol alkoxylate adducts of diglycidyl ether to one or more of the streams entering and/or said alkaline amine stream exiting a liquid/liquid absorber in said amine separation process whereby hydrocarbon entrainment in said alkaline amine stream exiting said liquid/liquid absorber is reduced.

2. The method of claim 1 wherein said non-foaming demulsifier is a alkoxylated adduct of poly(propylene glycol) and diglycidyl ether of 2,2 bis-p-phenol propane.

3. The method of claim 2 wherein the ratio of poly (propylene glycol) to diglycidyl ether of 2,2 bis-p-phenol propane ranges from about 1:3 to about 3:1.

* * * * *